US007347260B2

(12) United States Patent
Ferguson et al.

(10) Patent No.: US 7,347,260 B2
(45) Date of Patent: Mar. 25, 2008

(54) METHOD FOR DETERMINING TRACER CONCENTRATION IN OIL AND GAS PRODUCTION FLUIDS

(75) Inventors: Royce B. Ferguson, Addison, TX (US); Tom Hampton, Cypress, TX (US)

(73) Assignee: Core Laboratories LP, a Delaware Limited Partnership, Houston, TX (US)

( * ) Notice: Subject to any disclaimer, the term of this patent is extended or adjusted under 35 U.S.C. 154(b) by 0 days.

(21) Appl. No.: 11/256,795

(22) Filed: Oct. 24, 2005

(65) Prior Publication Data

US 2006/0144588 A1 Jul. 6, 2006

Related U.S. Application Data

(60) Provisional application No. 60/621,286, filed on Oct. 22, 2004.

(51) Int. Cl.
*E21B 47/01* (2006.01)

(52) U.S. Cl. ..... 166/250.12; 166/252.6; 166/371

(58) Field of Classification Search ..... None
See application file for complete search history.

(56) References Cited

U.S. PATENT DOCUMENTS

| | | | | |
|---|---|---|---|---|
| 3,059,909 | A | 10/1962 | Wise | 261/39 |
| 3,212,855 | A | 10/1965 | Mast et al. | 23/253 |
| 3,301,723 | A | 1/1967 | Chrisp | 149/20 |
| 3,888,312 | A | 6/1975 | Tiner et al. | 166/308 |
| 4,097,240 | A | 6/1978 | Hirsch | 23/253 TP |
| 4,147,514 | A | 4/1979 | Magers et al. | 23/230 B |
| 4,222,744 | A | 9/1980 | McConnell | 23/230 B |
| 4,742,873 | A * | 5/1988 | Craig, III | 166/252.6 |
| 5,140,134 | A | 8/1992 | Reusche et al. | 219/441 |
| 5,246,860 | A * | 9/1993 | Hutchins et al. | 436/27 |
| 5,458,852 | A | 10/1995 | Buechler | 422/58 |
| 5,892,147 | A | 4/1999 | Garnes et al. | 73/152.114 |
| 6,393,925 | B1 * | 5/2002 | Devlin | 73/861.05 |
| 6,645,769 | B2 | 11/2003 | Tayebi et al. | 436/56 |
| 6,659,175 | B2 | 12/2003 | Malone et al. | 166/250.1 |
| 6,881,953 | B2 | 4/2005 | Weiland et al. | 250/302 |
| 7,032,662 | B2 | 4/2006 | Malone et al. | 166/252.6 |
| 2005/0109087 | A1 * | 5/2005 | Robb et al. | 73/53.01 |

* cited by examiner

*Primary Examiner*—Zakiya W. Bates
(74) *Attorney, Agent, or Firm*—Madan, Mossman & Sriram, P.C.

(57) ABSTRACT

A method for determining the extent of recovery of materials injected or otherwise introduced into oil wells or subsurface formations is practiced using a portable device. The portable device can also be used to determiner the occurrence of a predetermined condition in an oil well such as water break through in a production zone, or the opening or closing of a sliding sleeve. When, for example, water breakthrough is detected, the zone producing too much water can be plugged, using, for example, a flow-through bridge plug, if there are other producing zones further downhole.

26 Claims, 1 Drawing Sheet

METHOD FOR DETERMINING TRACER CONCENTRATION IN OIL AND GAS PRODUCTION FLUIDS

RELATED APPLICATIONS

Figure 1:
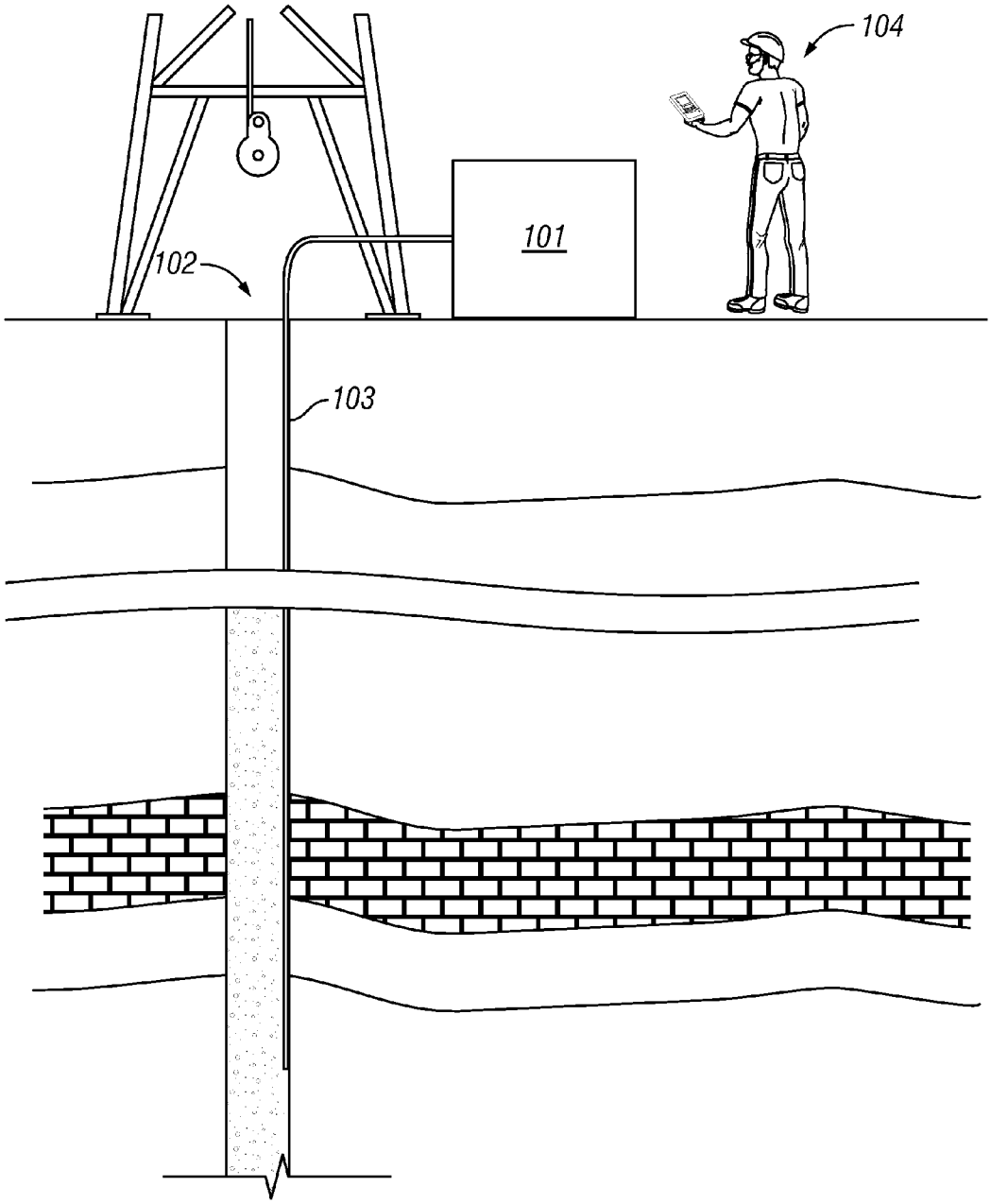

This application claims priority from the U.S. Provisional Patent Application having Ser. No. 60/621,286 filed Oct. 22, 2004.

BACKGROUND OF THE INVENTION

1. Field of the Invention

The present invention relates to a method for determining the amount of a tracer present in fluid from a well. The present invention particularly relates to determining the amount of tracer present in fluid from an oil and gas well.

2. Background of the Art

The present Invention relates generally to hydrocarbon (oil and gas) production from wells drilled in the earth, hereinafter referred to as "oil wells." Drilling a hole into the earth to reach oil and gas bearing formations is expensive which limits the number of wells that can be economically drilled. It follows then that it is desirable to maximize both and the overall recovery of hydrocarbon held in the formation and the rate of flow from the subsurface formation to the surface, where it can be recovered.

One way in which to maximize production is the process known as fracturing. Hydraulic fracturing involves literally breaking or fracturing a portion of the hydrocarbon bearing formation surrounding an oil well by injecting a specialized fluid into the wellbore directed at the face of the geologic formation at pressures sufficient to initiate and/or extend a fracture in the formation. Ideally, what this process creates is not a single fracture, but a fracture zone, i.e., a zone having multiple fractures, or cracks in the formation, through which hydrocarbon can more readily flow to the wellbore.

Creating a fracture in a hydrocarbon-bearing formation requires several materials. Often these materials, if not removed from the oil well, can interfere with oil and gas production. Even the drilling mud used to lubricate a drill bit during the drilling of an oil well can interfere with oil and gas production. Taking too long to remove such materials can increase the cost to the operator of the well by delaying production and causing excess removal expenses. Not being thorough in removing such materials can increase the cost to the operator of the well through lower production rates and possible lost production.

Measures taken to remove unwanted or unneeded materials are usually inexact. Sometimes additional fluids are used to flush out unwanted materials in the well bore. In other situations, reservoir fluids flow can make estimating return flow very difficult, particularly if the reservoir fluids are incompatible with the injected materials.

In other instances, particularly in situations where oil wells produce fluids from more than a single point in the well, it can be desirable to determine where fluids are entering an oil well. For example, when a well is piercing more than one reservoir, and one of the reservoirs begins to produce too little hydrocarbon, it may be desirable to plug that portion of the well to avoid excess water production.

It would be desirable in the art of oil production to be able to determine how much of a given material is left in an oil well after a drilling, fracturing or any other operation requiring the injection of materials into an oil well. In applications where fluid is being produced from more than a single location in an oil well, it would be desirable to be able determine what fluids are being produced at each production point in the well. It would be particularly desirable if such a determination could be made using an inexpensive and environmentally benign method. If would also be desirable if such a determination could be made quickly, on site, and cost efficiently.

SUMMARY OF THE INVENTION

In one aspect, the present invention is a method for determining the extent of recovery of materials injected or otherwise introduced into an oil well comprising: a) admixing a material to be injected or otherwise introduced into an oil well with at least one chemical tracer compound at a predetermined concentration; b) injecting or otherwise introducing the admixture into an oil well or an offset well associated with an oil well; c) recovering from the oil well a production fluid; and d) prescreening the production fluid for the presence of the at least one tracer using a portable device.

In another aspect, the present invention is a method for determining the extent of recovery of a material of interest injected or otherwise introduced into an oil well or a subsurface formation associated with a bore of the oil well comprising: a) introducing a material of interest into the oil well or into the subsurface formation associated with the bore of the oil well; b) introducing a tracer into the oil well or into the subsurface formation associated with the bore of the oil well; c) recovering from the oil well a production fluid; d) prescreening the production fluid for the presence of the at least one tracer using a portable device; e) analyzing the production fluid for a concentration of a chemical tracer present in the production fluid; and f) calculating the amount of material of interest recovered from the oil well using the concentration of the chemical tracer present in the production fluid as a basis for the calculation.

In yet another aspect, the present invention is a portable device for determining the amount of a tracer in production fluid from an oil well comprising a laminar flow device, a test strip, an agar device or a dip stick device wherein the device comprises a compound that interacts with the tracer to visibly indicate the presence of the tracer.

For a detailed understanding of the present invention, reference should be made to the following detailed description of the preferred embodiments, taken in conjunction with the accompanying drawing(s) wherein:

FIG. 1 is a drawing showing an oil well, a source of tracers, and an operator holding a portable device of the invention.

DESCRIPTION OF PREFERRED EMBODIMENTS

As already defined, the term "oil well" means hydrocarbon (oil and gas) production wells drilled in the earth. The method of the present invention can also be used with other types of wells that are drilled in the earth and can require stimulation by hydraulic fracturing, such as a well used for water flooding in secondary recovery operations in oil and gas production. For the purposes of the present invention, the term "oil well" means hydrocarbon production wells, such as those that can require stimulation by hydraulic fracturing but also means any other type of well used in oil and gas production. The method of the present invention can be used in either gas wells or oil wells, as well as in those wells producing significant quantities of both oil and gas.

In one embodiment, the present invention is a method for determining the amount of fracture materials recovered after the stimulation of an oil well by means of hydraulic fracturing. Creating a fracture in a hydrocarbon-bearing formation requires several materials. Most often these include a carrier fluid, a viscosifier, a proppant, and a breaker. Other components that are sometimes added include materials to control leak-off, or migration of the fluid into the fracture face, gel stabilizers, surfactants, clay control agents and crosslinkers.

The purpose of the first fracturing component is to first create/extend a fracture in an oil and gas producing formation and then, once it is opened enough, to deliver proppant. The carrier fluid together with proppant material is injected into the fractured formation. The carrier fluid is simply the means by which the proppant and breaker are carried into the formation.

Numerous substances can act as a suitable carrier fluid, though they are generally aqueous-based solutions that have been either gelled or foamed or both. Thus, the carrier fluid is often prepared by blending a polymeric gelling agent with an aqueous solution although sometimes the carrier fluid is oil-based or a multi-phase fluid. Often, the polymeric gelling agent is a solvatable polysaccharide, e.g., galactomannan gums, glycomannan gums, and cellulose derivatives. The purpose of the solvatable or hydratable polysaccharides is to thicken the aqueous solution so proppant can be suspended in the solution for delivery into the fracture.

The polysaccharides function as viscosifiers, increasing the viscosity of the aqueous solution by 10 to 100 times, or even more. During high temperature applications, a crosslinking agent is further added which further increases the viscosity of the solution. The borate ion has been used extensively as a crosslinking agent for hydrated guar gums and other galactomannans to form aqueous gels, e.g., U.S. Pat. No. 3,059,909. Other demonstrably suitable crosslinking agents include: titanium as disclosed in U.S. Pat. No. 3,888,312, chromium, iron, aluminum, and zirconium as disclosed in U.S. Pat. No. 3,301,723. More recently, viscoelastic surfactants have been developed which obviates the need for thickening agents, and hence cross-linking agents.

Most relevant to the present invention is the final step of the fracturing process. The process of removing the fluid from the fracture once the proppant has been delivered is referred to as "fracture clean-up." For this, the final component of the fracture fluid becomes relevant: the breaker. The purpose of the breaker is to lower the viscosity of the fluid so that it is more easily removed from the fracture.

In another aspect, the present invention is a method for determining the amount of drilling fluid recovered after the completion of an oil well. A drilling fluid is a fluid specially designed to be circulated through a wellbore as the wellbore is being drilled to facilitate the drilling operation. The circulation path of the drilling fluid typically extends from the wellhead down through the drill pipe string to the drilling face and back up through the annular space between the drill pipe string and wellbore face to the wellhead. The drilling fluid performs a number of functions as it circulates through the wellbore including cooling and lubricating the drill bit, removing drill cuttings from the wellbore, aiding in support of the drill pipe and drill bit, and providing a hydrostatic head to maintain the integrity of the wellbore walls and prevent well blowouts.

There are a number of different types of conventional drilling fluids including compositions termed "drilling muds." Drilling muds comprise high-density dispersions of fine solids in an aqueous liquid or a hydrocarbon liquid. An exemplary drilling mud is a dispersion of clay and/or gypsum in water. The solid component of such a dispersion is termed a "weighting agent" and is designed to enhance the functional performance of the drilling fluid.

In the practice of the present invention, the extent of recovery of materials injected or otherwise introduced into a oil well during fracturing, drilling and the like is determined by preparing the fracture materials or drilling fluids to be injected or otherwise introduced into an oil well and admixing therewith a chemical tracer compound at a predetermined concentration. The tracer acts as a model for determining the amount of these materials recovered. For purposes of the present invention, these materials are referred to as the materials for which the tracers are used as a model and sometimes just as the materials of interest.

In another embodiment, the present invention is a process or method for determining the location or origin for a fraction of the fluid being produced from an oil well that has more than a single production zone. In this embodiment of the invention, a tracer is introduced into the fluid being produced from one or more zones in an oil well. The introduction of the tracer can be by any method known to those of ordinary skill in the art of producing oil and gas. For example, the tracer can be introduced via an offset well. In the alternative, the tracer can be painted or otherwise fixed onto downhole equipment, casing, piping or even the formation itself, and then released under a predetermined condition, such as water break through which is the point in time where a formation ceases to produce hydrocarbons, or where there is a rapid change in the ration of hydrocarbon to water in the production fluid.

In one embodiment of the present invention, the portable devices are used with tracers that are visible, such as those described in U.S. Pat. No. 6,881,953. These tracers may include those commonly described in the art as dyes, pigments, and colorants. These compounds are often visible to the eye in either ambient or ultraviolet light. Suitable tracers useful with the present invention include but are not limited to those selected from the group consisting of: Acridine Orange (CAS Registry No. 65-61-2); 2-anthracenesulfonic acid, sodium salt; Anthrasol Green IBA (CAS Registry No. 2538-84-3, aka Solubilized Vat Dye); bathophenanthrolinedisulfonic acid disodium salt (CAS Registry No. 52746-49-3); amino 2,5-benzene disulfonic acid; 2-(4-aminophenyl)-6-methylbenzothiazole; Brilliant Acid Yellow 8G (CAS Registry No. 2391-30-2, aka Lissamine Yellow FF, Acid Yellow 7); Celestine Blue (CAS Registry No. 1562-90-9); cresyl violet acetate (CAS Registry No. 10510-54-0); dibenzofuransulfonic acid, 1-isomer (CAS Registry No. 42137-76-8); dibenzofuransulfonic acid, 2-isomer (CAS Registry No. 257627-62-2); 1-ethylquinaldinium iodide (CAS Registry No. 606-53-3); fluorescein (CAS Registry No. 2321-07-5); fluorescein, sodium salt (CAS Registry No. 518-47-8, aka Acid Yellow 73, Uranine); Keyfluor White ST (CAS Registry No. 144470-48-4, aka Flu. Bright. 28); Keyfluor White CN (CAS Registry No. 16470-24-9); Leucophor BSB (CAS Registry No. 68444-86-0, aka Leucophor AP, Flu. Bright. 230); Leucophor BMB (CAS Registry No. 16470-24-9, aka Leucophor U, Flu. Bright. 290); Lucigenin (CAS Registry No. 2315-97-1, aka bis-N-methylacridinium nitrate); mono-, di-, or tri-sulfonated napthalenes, including but not limited to—1,5-naphthalenedisulfonic acid, disodium salt (hydrate) (CAS Registry No. 1655-29-4, aka 1,5-NDSA hydrate); —2-amino-1-naphthalenesulfonic acid (CAS Registry No. 81-16-3); 5-amino-2-naphthalenesulfonic acid; 4-amino-3-hydroxy-1-naphthalenesulfonic acid; 6-amino-4-hydroxy-2-naphthalenesulfonic acid; 7-amino-1,3-naphthalenedisulfonic acid, potassium salt; 4-amino-5-hydroxy-2,7-naphthalenedisulfonic acid; 5-dimethylamino-1-naphthalenesulfonic acid; 1-amino-4-naphthalene sulfonic acid; 1-amino-7-naphthalene sulfonic acid; and 2,6-naphthalenedicarboxylic acid, dipotassium salt; 3,4,9,10-perylenetetracarboxylic acid; Phorwite CL (CAS Registry No. 12270-53-0, aka Flu. Bright. 191); Phorwite BKL (CAS Registry No. 61968-72-7, aka Flu. Bright. 200); Phorwite BHC 766 (CAS Registry No. 52237-03-3); Pylaklor White S-15A (CAS Registry No. 6416-68-8); 1,3,6,8-pyrenetetrasulfonic acid, tetrasodium salt; pyranine, (CAS Registry No. 6358-69-6, aka 8-hydroxy-1,3,6-pyrenetrisulfonic acid, trisodium salt); quinoline (CAS Registry No. 91-22-5); Rhodalux (CAS Registry No. 550-82-3); Rhodamine WT (CAS Registry No. 37299-86-8); Safranine O (CAS Registry No. 477-73-6); Sandoz CW (CAS Registry No. 56509-06-9, aka Flu. Bright, 235); Sandoz CD (CAS Registry No. 16470-24-9, aka Flu. Bright. 220); Sandoz TH-40 (CAS Registry No. 32694-95-4); Sulforhodamine B (CAS Registry No. 3520-42-1, aka Acid Red 52); Tinopal 5BM-GX (CAS Registry No. 169762-28-1); Tinopol DCS (CAS Registry No. 205265-334); Tinopal CBS-X (CAS Registry No. 27344-41-8); Tinopal RBS 200; Titan Yellow (CAS Registry No. 1829-00-1, aka Thiazole Yellow G), and any existing ammonium, potassium and sodium salts thereof.

Other visible tracers useful with the present invention include fluoroscein (aka yellow/green dye) and rhodamine WTS (aka red dye). Other dyes which could be used with the present invention would be readily determined by a skilled chemist with routine experimentation by seeing which dyes have the desired organic solvent solubility and selective solubility in a particular application. Any such dye, pigment or colorant known to those skilled in the art of using visible tracers in oil well applications to be useful may be used with the present invention.

Non-visible tracers may also be used. The tracers useful with the present invention include any known to those ordinary skill in the art of using chemical tracers in oil and gas operations to be useful, but preferably are those which can be detected at concentrations low enough to make their use economically practical in such operations and low enough not to interfere with the carrier fluid or other materials present in the oil well. The useful tracers may also be able to interact with the measurement devices of the invention, in some applications.

Preferably the chemical tracers useful with the present invention include but are not limited to: fluorinated benzoic acids including 2-fluorobenzoic acid; 3-fluorobenzoic acid; 4-fluorobenzoic acid; 3,5-difluorobenzoic acid; 3,4-difluorobenzoic acid; 2,6-difluorobenzoic acid; 2,5-difluorobenzoic acid; 2,3-difluorobenzoic acid; 2,4-difluorobenzoic acid; pentafluorobenzoic acid; 2,3,4,5-tetrafluorobenzoic acid; 4-(trifluoro-methyl)benzoic acid; 2-(trifluoromethyl) benzoic acid; 3-(trifluoro-methyl)benzoic acid; 3,4,5-trifluorobenzoic acid; 2,4,5-trifluorobenzoic acid; 2,3,4-trifluorobenzoic acid; 2,3,5-trifluorobenzoic acid; 2,3,6-trifluorobenzoic acid; 2,4,6-trifluorobenzoic acid; and the like, perfluoromethylcyclopentane (PMCP), perfluoromethylcyclohexane (PMCH), perfluorodimethylcyclobutane (PDMCB), m-perfluorodimethylcyclohexane (m-PDMCH), o-perfluorodimethylcyclohexane (o-PDMCH), p-Perfluorodimethylcyclohexane (p-PDMCH), perfluorotrimethylcyclohexane (PTMCH), perfluoroethylcyclohexane (PECH), perfluoroisopropylcyclohexane (IPPCH), and the like.

Any chemical compound can be used as tracer with the present invention if: it is not present at a measurable level in the reservoir fluids being produced from the well being tested, it can be measured at levels sufficiently low to allow its use to be economical, and the tracer does not interfere or interact undesirably with other materials present in the oil well at the levels used. Preferably, the tracers are detectable at a range of from about 1 parts per trillion to about 10,000 parts per million in the fluid being analyzed. Preferably the tracers are detectable at a range of from 5 parts per trillion to about 1,000 parts per million. More preferably the tracers are detectable at a range of from 100 parts per trillion to about 100 parts per million. At concentrations greater than about 1000 parts per million, the use of some tracers can become prohibitively expensive or cause unacceptable interactions with other materials present in an oil well.

In one embodiment of the present invention, the tracers are desirably compatible with the fluids wherein they are used. Preferably, the tracer selected is chosen to be more compatible with the injected materials than with the reservoir fluids which may recovered concurrently with the injected materials. The fluorinated benzoic acids are particularly preferred as tracers for the present invention because they are compatible in both aqueous fluids as a salt and in organic based fluids as an acid.

In an alternative embodiment of the present invention, more than one tracer can be used to measure multiple operations in the same well. For example, oil wells often have more than one producing strata or zone. In the practice of the present invention, a fracture job could be done on one strata using a first tracer and a fracture job could be done on another strata using a second tracer. In recent years, horizontal drilling has allowed for the drilling of multiple bores terminating in a common bore which connects to the surface. In multilateral wells such as these, several different tracers could be used to keep track of concurrent recovery of materials from the several legs (lateral bores) of such wells.

In a similar but different embodiment, the method of the present invention is used in a process to fracture stimulate multiple intervals in single or multiple formations, within the same wellbore. This is performed by: (i) perforating a first interval; (ii) stimulating that first interval; (iii) isolating the first interval, (iv) perforating a second interval; (v) stimulating the second interval; (iii) isolating the second interval; and continuing this pattern. There may be as many as 12 or 13 such stimulations done on a single wellbore in a short period of time, sometimes only weeks or even days. The operator of the well then retrieves the isolation mechanism, typically a bridge plug, between each interval and begins to clean up all of the stimulated intervals, often at one time. The method of the present invention is very useful in such an operation because a different tracer can be used in each interval and thus can be individually detected during the flowback. The method of the present invention thereby provides an opportunity for a well operator to determine which to what extent each of the intervals is contributing to the flowback.

In the practice of one embodiment of the present invention, a tracer is admixed with a material that is to be injected or otherwise introduced into an oil well. The tracer can be premixed with the injection material or it can be admixed as it is injected. Preferably the tracer is admixed with the injection material through a static mixer as the admixture is pumped into the oil well. Any method known to those of ordinary skill in the art of admixing and injecting or otherwise introducing materials into oil wells can be used with the method of the present invention.

In one preferred embodiment, where a stream of fluids used for a hydraulic fracture job is being pumped into an oil well, a ten percent solution of a fluorinated benzoic acid salt tracer is pumped into the stream of fluids being used for a hydraulic fracture job, just upstream of a static mixer, using a peristaltic pump to meter the tracer into the stream of fluids. In another preferred embodiment, the pump used to feed the tracer solution into the fracture fluids is a triplex or a centrifugal pump. In either embodiment, the metering pump is adjusted such that the tracer is injected or otherwise introduced into the fracture fluids at a rate that results in a predetermined tracer concentration appropriate for the conditions in the oil well. The same process can also be used for injecting or otherwise introducing tracer into a stream of drilling fluids.

Use of the portable devices of the present invention allows for at least two advantages in the operation of oil and gas wells. A first advantage is cost savings. Use of the portable devices can save on test costs and wasted production costs through avoidance of excess testing. The second advantage is the avoidance of delay in waiting on testing results while undesirable conditions, such as water breakthrough, are occurring.

In the practice of the present invention, the chemical tracer compound is admixed with a material to be injected or otherwise introduced into an oil well at a predetermined concentration. The concentration of the tracer is above its detection limits and preferably at a concentration of ten times its detection limits. In the practice of the present invention, preferably the concentrations of the tracer and the total amount of admixture injected or otherwise introduced is determined and known.

After the fluid injected or otherwise introduced into an oil well during the practice of the present invention has performed its purpose, it is preferably recovered. Most often, the injected or otherwise introduced materials are recovered along with reservoir fluids as a production fluid. In the practice of hydraulic fracturing of wells, this phase of the process is the fracture clean up. In conventional practices, this process can take an extended amount of time where up to 72 hours would not be unusual. In some instance, fracture cleanup may take months.

In the practice of one embodiment of the present invention, the recovered materials are tested for tracer concentration and the amount of material recovered determined. At this point, the well operator can make an informed decision regarding whether to continue clean up or begin production. An advantage of the present invention is that it allows the well operator to avoid unnecessary down time, but prevents premature termination of clean up operations. Down time and premature termination of clean up operations can be very expensive to well operators.

In another embodiment of the present invention, the production fluid of an oil well is tested for the presence or absence of a tracer. This test can be useful as a prescreening to determine whether a quantitative analysis is needed. In another embodiment, the test can be done to monitor for water break through in production zone.

In yet another embodiment, the portable device is used to monitor the return of a visible tracer, but a second different tracer is used for quantitative determinations. For example, a frac job could be monitored using both an FBA tracer, such as 3-fluorobenzoic acid, and one of the visible tracers. In one such embodiment, the return of the visible tracer is monitored using a portable device of the invention, and then, after the first sample having tracer is observed, a sample schedule is put into place for doing quantitative analyses for the FBA tracer using a gas chromatograph mass spectrometer.

The extent of recovery of materials injected including a tracer of the present invention is preferably determined by using a mass balance approach. Therein, the total amount of tracer admixed with the injected or otherwise introduced material is a known. A homogenous sample of production fluid is tested for tracer concentration and the amount of tracer recovered is thereby determined. The amount of injected or otherwise introduced admixture recovered is then determined using the formula:

$$AMT_r=((T_r/T_i)\times AMT_i)$$

wherein $AMT_r$ is the amount of injected or otherwise introduced admixture recovered, $T_i$ is the amount of tracer injected; $T_r$ is the amount of tracer recovered; and $AMT_i$ is the amount of materials injected. $T_r$ is determined by multiplying the concentrations of the tracer in the production fluid by the total quantity of production fluid recovered.

Where a mass balance approach is not possible or desirable, a relative rate of recovery can also be determined by measuring the concentration of tracer in the production fluids recovered from an oil well as a function of time. In a process such as this, samples of production fluid being recovered from the well are taken, analyzed for tracer concentration that is then plotted against time and/or flow rates. This can also be a desirable way for an operator to decide when to terminate clean up and begin production from an oil well.

The tracers can be tested with device of the invention using any sample preparation useful with the devices of the invention. Such sample preparation can range from no sample preparation at all to a complete sample clean up and tracer concentration process. For example, the sample to be tested with the device of the invention can be centrifuged or filtered to remove particulate matter or buffered in order to allow more efficient detection of the analyte.

In some embodiment, where the devices of the present invention are used to merely screen samples to determine whether further testing is necessary, the tracers can be analyzed by any method known to those of ordinary skill in the art of doing such analyses to be useful. For example, in one method of analyzing for a fluorinated benzoic acid tracer of the present invention, an emulsion of hydrocarbons, water and naturally occurring inorganic materials is first acidified with dilute hydrochloric acid and then extracted using a nonpolar solvent. The organic phase is then admixed with a 1 normal sodium hydroxide solution and then extracted with water. The water is then reacidified and extracted with methylene chloride. The recovered methylene chloride is then analyzed for the tracer, optionally after being reduced in volume by evaporation.

In addition to methylene chloride, other solvents can be used. For example, cyclohexane, normal hexane, pentane, can be used. While not preferred, organic solvents such as benzene and toluene can also be used as long as care is used to make sure that the solvent does not have a significant background level of the tracer being used.

In the case of the fluorinated benzoic acid tracers, very low levels of tracer can be determined by taking advantage of the carboxylate group to first separate the tracer from non-acidic organics as a salt and then, in a second step, concentrate the tracer into an organic solvent by returning it to its acid form and then extracting it from an aqueous phase.

There are many instrumental methods of analyzing for the tracer compounds useful with the method of the present invention, including but not limited to, gas chromatography (GC) using flame ionization detectors, electron capture detectors, and the like; liquid chromatography (LC); infrared spectroscopy; combination instrumentation such as Fourier transform infrared spectroscopy, GC-mass spectroscopy, LC-mass spectroscopy, and the like.

When especially demanding analytical conditions arise, other means of doing the analyses can also be used, including using biologically active tracers for immunoassay, preparing functional derivatives of the tracers including, for example, esterifacation with more easily analyzed alcohols, and the like.

To achieve low levels of detection, it is necessary that standard laboratory practices be maintained. Fluids produced from oil wells can contain hazardous or toxic materials and steps should be taken to ensure the safety of lab personnel including, but not limited to, avoiding fire hazards, scrubbing or removing $H_2S$ and other harmful gasses, and limiting skin contact with possible carcinogens. Quality assurance should be done as with any analytical procedure including using internal standards, external standards, and the like to ensure the accuracy of analyses. Recovery efficiencies can vary from oil well to oil well. It is important not to overlook simple steps such as accurately measuring sample volumes and filtering irrelevant solids from samples prior to analysis. Any analytical method that can detect the chemical tracers useful with the method of the present invention at useful levels can be used with the present invention.

In another embodiment of the present invention, the tracer is in the form of a coating on a solid substrate or as a fluid or solid trapped in the pores of a porous support. The tracer can also be in the form of a pellet admixed with solids soluble in the production fluid. In these embodiments, the tracer is released gradually into production fluid over time. When co-injected with solids such as proppant or pack sand, this use of the tracers of the present invention would allow for an estimation of the amount of co-injected solids in place in the well. If too little tracer were detected after completion of the injection, or if the tracer level decreased too quickly after completion, an oil well operator would know that the injected solids were either not properly placed in the well or are being washed out or otherwise being removed from the oil well.

In a similar embodiment, the tracer is fixed downhole and left in place until a predetermined set of conditions occur to release the tracer to indicate a condition requiring attention. For example, a tracer useful with the invention can be fixed upon a screen, painted onto a section of production tubing, attached down hole in the form of a pellet, or any other way known to be useful for putting something down hole and in the flow of the production fluid. In an embodiment for determining water breakthrough, the tracer is fixed in a medium that is substantially hydrophilic. The hydrophilic medium will be stable in a production fluid where a hydrocarbon is the continuous phase, but will degrade when the level of water in the production fluid becomes the continuous phase thereby releasing the tracer which can then be detected downstream. In such a situation, an operator may elect to then block off the flow of fluid from the zone of the well where the fluid originates.

When practicing this aspect of the invention, the well operator may choose one of several types of plugs. For example, if the deepest zone is the one that has water breakthrough, then the operator may plug that zone by merely filling in the well to that point with sand, gravel or other fill material. If there are three or more producing zones and one of the middle zones has water breakthrough, then the operator may elect use a flow through bridge plug to ensure that production from the other zones is not reduced.

The tracer can be produced in other forms as well. In one embodiment, the tracer is introduced down hole by using an elastic band or a tape that has been impregnated with the tracer. The use of the tracer in this form could be particularly useful in applications such as detecting the function of downhole equipment such as a sliding sleeve.

A sliding sleeve is a device or tool that is typically installed in or onto a string of casing or in production tubing in a well bore intersecting a plurality of formations of the earth. The sliding sleeve is often used in evaluating the characteristics of a formation surrounding the sliding sleeve. The sliding sleeve is capable of being repeatedly opened and closed any desired number of times to allow fluids to be selectively produced from the formation and, if desired, fluids to flow from the casing or production tubing into the formation when apertures allowing fluid communication between the exterior and interior of the sliding sleeve have been created therein. In one embodiment of the present invention, a dye is introduced downhole in such a way that when the sliding sleeve is operated, the dye is exposed to formation fluid that then returns to the surface and can be detected thereby confirming tool operation.

In a similar embodiment, the present invention can be practice wherein the tracer is in the form of an encapsulated liquid or solid. The encapsulating agent can selected from natural and synthetic oils, natural and synthetic polymers and enteric polymers and mixtures thereof. Preferably the encapsulating agent is selected from crosslinked vegetable oils, natural or synthetic polymers (such as polyvinylchloride and nylon), enteric polymers (such as acrylic resin polymers, cellulose acetate phthalate, carboxylated polymers, aqueous methacrylic polymers, and mixtures thereof.

The process of encapsulating the tracers of the present invention somewhat depends upon both the tracer and the encapsulating agent selected. In one embodiment the encapsulation process involves the coating of solid organic tracer with vegetable oil. One of skill in the art should be capable of accomplishing this by the combination of the tracer and vegetable oil in an agglomerator or other similar devise that coats solid particles with a protective coating. Alternatively the tracer can be encapsulated within polyvinylchloride or other polymers. There are many ways that those skilled in the art can encapsulate materials. Among these are in situ polymerization, interfacial polymerization, complex coacervation, polymer/polymer phase separation, desolvation, extrusion, thermal gelation, and ionic gelation. Any form of encapsulation known to those of ordinary skill in the art of encapsulation can be used with the present invention subject to the limitation that the encapsulation must release the tracer in a predictable manner one the tracer is downhole.

While the method of the present invention is particularly suitable for use with fracturing operations in an oil and gas well, it can be used with other types of operations and in other than just the main or primary production wellbore. For example, the method of the present invention can be used with chemical stimulation methods. Other stimulation methods that can be used with the present invention include, but are not limited to "break down"; "mini frac tests"; water block treatments; and in situ fluid compatibility testing for use with water based fluids. The method of the present invention can be used with almost any process wherein materials of interest are introduced to a wellbore and/or producing formation and wherein it would be desirable to be able to determine the extent that such materials have been recovered.

In one embodiment of the present invention, the tracers are introduced downhole into a production well. This is not the only way in which to practice the method of the present invention. In another embodiment, the tracers are introduced into the well using an offset well. An offset well is an existing wellbore close to the subject oil well that provides information for planning or operating the subject oil well. In this embodiment, the tracers and the materials for which the tracers are going to be used to model recovery can both be introduced into the formation using an offset well. In a related embodiment, the offset well can have a junction with the bore of a subject oil well. In still another embodiment, either one of the tracer or material for which the tracer will be a model can be injected or otherwise introduced into an offset well with the other material being introduced downhole through the subject oil well.

In a preferred embodiment, the tracers are admixed with the material for which they will serve as a model, but in another embodiment, the materials of interest and tracers are introduced separately. For example, the tracers of the present invention can be introduced downhole into an oil well or offset well using a dump bailer or other means of introducing small amounts of solids or slurries downhole. Downhole injection using a surface or even a subsurface pump is also within the scope of the present invention. The method of the present invention can be used with any scheme for introducing the material to be modeled and the tracers downhole so long as there is a known relationship between the tracers and the material for which the tracers will serve as a model that will allow for the calculation of recovery of the material of interest using the recovery of the tracers.

The devices used to determine the presence of a tracer in production fluid useful with the present invention are portable, preferably hand-held and, in some embodiments, can be used with a minimum of sample preparation. For example, in one embodiment, the device is a lateral flow device such as is disclosed in U.S. Pat. No. 6,140,134, the contents of which are incorporated herein by reference. FIG. 1 shows an oil well (102), a source of a fluid including a tracer (101), a line for injecting the fluid including a tracer (103); and an orerator at the well holding a handheld device of the invention (104).

With this portable device, an analyte gradient may be established in numerous ways. For example, a sample can be applied to a wedge-shaped sample application pad, a diluent can be applied to a wedge-shaped diluent application pad, with the gradient being established by bringing the sample and diluent application pads into contact with one another. These pads may consist of an absorbent material, examples of which are given below. Although it is expected that the analyte gradient will be established with sample and diluent application pads or chambers that are both wedge shaped, a gradient may be established by applying either the sample to a wedge-shaped pad and the diluent to a square or rectangular shaped pad, and vice-versa. The sample and diluent application pads or chambers can be designed to create a linear or non-linear analyte concentration gradient.

The edges of the sample and diluent application pads may be smooth, or one or more of their edges may be stepped, as stairs are stepped. The horizontal and vertical aspects of each step may be the same length, or one aspect may be longer than the other. Similarly, all of the steps may be identical, or they may differ. For example, the steps at the periphery of the gradient may be larger than the steps in the center of the gradient.

Alternatively, the analyte gradient may be produced by applying the sample to a wedge-shaped sample application chamber, applying a diluent to a wedge-shaped diluent application chamber, and bringing the contents of these two chambers into contact with one another. The chambers may be constructed from any material that is capable of forming and retaining a shape. Examples of such materials include plastics, plexiglass, and glass. The chambers may be shaped to create either a smooth or a stepped analyte gradient, as described above. To establish a stepped gradient, the sample-containing chamber and/or the diluent-containing chamber may be subdivided into a parallel array of wells that end squarely where the sample- and diluent-containing chambers are brought into contact with one another. The wells could be manufactured, for example, by adjoining a series of capillaries of varying height.

An array of capillary channels can serve as an absorptive "pad"; such a system is described in Buechler U.S. Pat. No. 5,458,852, hereby incorporated by reference. Buechler describes the use of capillary channels and capillary arrays as flow control elements, measurement elements, time gates, and generally as elements for controlled flow, timing, delivery, incubation, separation, washing, and other steps of assay processes. In the present invention, Buechler's capillary arrays can be configured, for example, to form complimentary wedge-shaped chambers. An analyte gradient may then be produced by applying the sample to one of the wedge-shaped capillary array chambers so as to fill the array of capillary channels with sample, applying a diluent to a second complimentary wedge shaped capillary array chamber so as to fill the capillary channels in this array with diluent, and bringing the contents of these two chambers together. The chambers can be brought together either by direct physical contact of the opposing capillary channels or by creating a liquid conductive bridge between the opposing capillary channels. The liquid conductive bridge may be composed of material that is capable of absorbing liquid. Such materials include but are not limited to high density polyethylene, paper, nitrocellulose, glass fiber, polyester, nylon, polycarbonate, polyamide, and olefins or thermoplastic materials (e.g., polyvinylchloride, polyvinylacetate, copolymers of vinyl acetate, and vinyl chloride). The use of capillary arrays provides a means for metering precise volumes of liquid, as each capillary channel will hold a precise volume. In addition, the use of an array of capillary channels prevents the possibility of "cross talk," thus aiding in the establishment of a sharply defined gradient.

The analyte gradient will move, as further described below, into contact with either a mobile binding member in the indicator zone or a fixed binding member in the test zone. For example, in the first embodiment, the analyte gradient contacts the indicator zone, wherein the analyte associates with a mobile binding member. Subsequently, the mobile binding member, or the analyte associated therewith, comes into contact with the test zone and associates with a fixed binding member therein. Alternatively, the mobile binding member may be associated with an analogue of the analyte that has a different, preferably lower, binding affinity for the mobile binding member than does the analyte. In this instance, the analyte would displace the analogue, which may subsequently associate with the fixed binding member in the test zone. In the second embodiment, the analyte gradient contacts the test zone directly and associates with a fixed binding member therein. In the third embodiment, the analyte gradient first contacts the test zone and associates with a fixed binding member therein. Subsequently, the indicator zone is brought into contact with the test zone and a mobile binding member (from the indicator zone) associates with either the fixed binding member in the test zone or the analyte associated therewith.

Other embodiments of this portable device can also be used with the present invention. Any embodiment of the invention disclosed in the U.S. Pat. No. 6,140,134 patent reference can be used with the present invention.

Another embodiment of the present invention is portable device that holds an agar impregnated with a compound that can combine with a tracer to produce a visible change in the agar. In one such application, the sample is placed into a well cut into the agar. As the sample diffuses into the agar, the tracer combines with the compound. In a qualitative test, the agar is inspected for any change indicating the presence of the tracer. In a quantitative test, the distance the tracer travels into the agar is measured and the concentration the tracer in the sample is thereby determined.

The method of the invention can be practiced using a dip-stick portable device. In this embodiment, the portable device is a stick composed of and absorbent medium such as paper or silica gel on a stick like support. The silica gel or paper is saturated with a compound that interacts with the tracer to produce a visible change on the paper or silica gel when the dip-stick device is place into a sample. In an alternative form of this device, the sample is applied to one end of the device and the distance the tracer travels up the dip-stick is measured and used to determine tracer concentration.

Variations of these and similar portable devices can be found in, for example: Magers, et al., U.S. Pat. No. 4,147,514 discloses test strips for the detection of ketone bodies; U.S. Pat. No. 3,212,855 and U.S. Pat. No. 4,097,240 disclose a "dipstick" device; U.S. Pat. No. 4,222,744 discloses an agar portable device. All of these patents are incorporated herein by reference and the devices disclosed therein, modified to include compounds that can interact with the tracers of the invention can be used with the method of the invention.

It should be noted that the agar portable devices can be prepared using gels other than agar. For example, they may be prepared using waxes, silica gel, gelatin, and the like. In a preferred embodiment, agar is used.

In the practice of the invention, the terms concentration and amount do not necessarily mean the same thing. For example, the method of the present invention can be used is a pre-screening mode wherein the portable device is used to make a simple yes/no determination regarding the presence or absence of a tracer. In contrast, the method of the present invention can be used to make a determination of the concentration of a tracer in percent or parts per million.

The following examples are provided to illustrate the present invention. The examples are not intended to limit the scope of the present invention and they should not be so interpreted. Amounts are in weight parts or weight percentages unless otherwise indicated.

EXAMPLE 1

A field application of the method of the present invention is performed in an oil and gas well. A first material (referred to in the art of hydraulic fracturing as a "stage" or, in this case, "the first stage") is prepared for fracture injection into the well including 0.15 gallons per thousand gallons (gpt) buffer and 1 gpt of GBW23L* which is a high temperature oxidizing gel breaker, 40 pounds per thousand pounds (ppt) gelling agent, and a first fluorinated benzoic acid tracer; in water. A second stage is prepared which includes 1-to-2 lbs/gal proppant; 0.15 gpt buffer; 1 gpt of GBW23L; 1 gpt BC31* gel breaker activator which is a low temperature oxidizing breaker activator; 40 ppt gelling agent; a second fluorinated benzoic acid tracer; and 2.5 (ppt) gel stabilizer, in water. A third stage is prepared which includes 3 lbs/gal proppant; 40 ppt gelling agent; 0.20 gpt buffer; 1 gpt GBW23L; 1 gpt BC31; 1 ppt Ultra Perm* breaker which is a low temp oxidizing breaker; 1 ppt gel stabilizer; a third fluorinated benzoic acid tracer; and 1.5 ppt gel crosslinking agent, in water. A fourth stage is prepared which includes 4 lbs/gal proppant; 40 ppt gelling agent; 0.20 gpt buffer; 3 ppt GBW5 breaker which is a low temp oxidizing breaker; a fourth fluorinated benzoic acid tracer, and 1 ppt Ultra Perm. *GBW-23L, BC31, GBW5 and Ultra Perm are trade designations of BJ Services.

Each stage is injected, in turn, under fracture injection conditions. The samples are prescreened for the presence of tracer using a lateral flow portable device.

Once the presence of tracer is indicated in the prescreening, the samples are then further tested for the presence and relative concentration of each tracer using a GC-mass spectrometer. The comparative amounts of tracer returned are: (A) Fourth fluorinated benzoic acid tracer highest concentration; (B) Second fluorinated benzoic acid tracer next highest concentration; (C) First fluorinated benzoic acid tracer next highest concentration; and (D) Third fluorinated benzoic acid tracer lowest concentration.

While not wishing to be bound by any theory, it can be concluded that the third material injected had the most stable gel structure, effectively locking it into the formation and thus had the lowest flow back and resulting in the lowest recovery of tracer. It can also be concluded that the fourth material, being last injected and replete with gel breaking materials would have the greatest flowback and thus the highest recovery of tracers.

EXAMPLE 2

An oil well having three production zones is completed using a separate sand screen for each producing zone. Each screen is treated with a tracer impregnated hydrophilic gel. 28 months after the completion, the operator notes that water production from the well has increased by 34 percent as compared to the period ending 30 days from the initial completion with a corresponding loss in hydrocarbon production. The production fluid is tested using a laminar flow portable device for the presence of the tracers. The portable device shows the presence of tracer from zone 2. The operator then plugs zone 2. Water production and hydrocarbon return to near completion levels within 72 hours.

EXAMPLE 3

Example 2 is repeated except that the samples from the test are returned to a laboratory where a quantitative analysis is done using a GC-Mass Spec. It is determined that tracer from Zone 3 is also present in the samples, but at a lower concentration than tracer from Zone 2, but at a greater concentration than tracer from Zone 1. The well operator establishes a new sampling schedule to increase surveillance of Zone 3 for water breakthrough.

What is claimed is:

1. A method for determining the extent of recovery of materials injected or otherwise introduced into an oil well comprising:

a) admixing a material to be injected or otherwise introduced into an oil well with at least one chemical tracer compound at a predetermined concentration;

b) injecting or otherwise introducing the admixture into an oil well or an offset well associated with an oil well;

c) recovering from the oil well a production fluid; and d) prescreening the production fluid for the presence of at least one tracer using a portable device;

wherein the portable device is selected from the group consisting of a lateral flow device;

an impregnated agar device; a dipstick device and a test strip device.

2. The method of claim 1 further comprising:

i) if no tracer is detected during the prescreening, concluding that if no tracer has been detected in prior samples, then none of the admixture has yet been recovered.

3. The method of claim 1 wherein the at least one tracer used for prescreening is a dye, pigment, or colorant and the at least one tracer not used for prescreening is selected from the group consisting of fluorinated benzoic acids.

4. The method of claim 1 wherein the at least one tracer is present in the admixture injected or otherwise introduced into an oil well at a concentration of at least about 1 part per trillion.

5. The method of claim 4 wherein the at least one tracer is present in the admixture injected or otherwise introduced into an oil well at a concentration of less than or equal to 10,000 parts per million.

6. The method of claim 5 wherein the at least one tracer is present in the admixture injected or otherwise introduced into an oil well at a concentration of from about 100 parts per trillion to about 100 parts per million.

7. The method of claim 1 wherein the material injected or otherwise introduced into the oil well is a hydraulic fracturing fluid.

8. The method of claim 1 wherein the material injected or otherwise introduced into the oil well is a chemical stimulation fluid.

9. The method of claim 1 wherein the at least one tracer is in the form of a coating on a solid support.

10. The method of claim 1 wherein the tracer is in the form of a liquid or solid within the pores of a porous support.

11. The method of claim 1 wherein the tracer is in the form of an encapsulated liquid or solid.

12. A method for determining the extent of recovery of a material of interest injected or otherwise introduced into an oil well or a subsurface formation associated with a bore of the oil well comprising:

a) introducing a material of interest into the oil well or into the subsurface formation associated with the bore of the oil well;

b) introducing at least one tracer into the oil well or into the subsurface formation associated with the bore of the oil well;

c) recovering from the oil well a production fluid;

d) prescreening the production fluid for the presence of the at least one tracer using a portable device;

e) analyzing the production fluid for a concentration of at least one chemical tracer present in the production fluid; and f) calculating the amount of material of interest recovered from the oil well using the concentration of the at least one chemical tracer present in the production fluid as a basis for the calculation;

wherein the portable device is selected from the group consisting of a lateral flow device; an impregnated agar device; a dipstick device and a test strip device.

13. The method of claim 12 wherein the at least one tracer used for prescreening in step d) and the tracer analyzed in step e) are the same or different.

14. The method of claim 13 the wherein the at least one tracer used for prescreening in step d) and the tracer analyzed in step e) are different and the tracer used for prescreening is a dye, pigment or colorant and the tracer not used for prescreening is a fluorinated benzoic acid selected from the group consisting of 2-fluorobenzoic acid; 3-fluorobenzoic acid; 4-fluorobenzoic acid; 3,5-difluorobenzoic acid; 3,4-difluorobenzoic acid; 2,6-difluorobenzoic acid; 2,5-difluorobenzoic acid; 2,3-difluorobenzoic acid; 2,4-difluorobenzoic acid; pentafluorobenzoic acid; 2,3,4,5-tetrafluorobenzoic acid; 4-(trifluoro-methyl)benzoic acid; 2-(trifluoromethyl)benzoic acid; 3-(trifluoro-methyl)benzoic acid; 3,4,5-trifluorobenzoic acid; 2,4,5-trifluorobenzoic acid; 2,3,4-trifluorobenzoic acid; 2,3,5-trifluorobenzoic acid; 2,3,6-trifluorobenzoic acid; and 2,4,6-trifluorobenzoic acid.

15. The method of claim 12 wherein the material of interest and/or at least one tracer is introduced into the oil well or subsurface formation through the oil well.

16. The method of claim 12 wherein the material of interest and/or at least one tracer is introduced into the oil well or subsurface formation through an offset well.

17. A method for determining a characteristic of an oil well comprising fixing a tracer downhole and determining the presence or absence of the tracer in production sample using a portable device wherein the tracer is fixed upon a screen, painted onto a section of production tubing, or attached down hole in the form of a pellet or tape.

18. The method of claim 17 wherein the tracer is released upon the occurrence of a predetermined condition.

19. The method of claim 18 wherein the predetermined condition is a water breakthrough.

20. The method of claim 19 further comprising plugging a zone producing too much water.

21. The method of claim 20 wherein the plug is a flow-through bridge plug.

22. The method of claim 18 wherein the predetermined condition is the opening of a sliding sleeve.

23. A portable device for determining the amount of a tracer in production fluid from an oil well selected from the group consisting of a lateral flow device, a test strip, an agar device or a dip stick device wherein the device comprises a compound that interacts with the tracer to visibly indicate the presence of the tracer.

24. The portable device of claim 23 wherein the portable device is used to determine the presence or the absence of the tracer.

25. The portable device of claim 23 wherein the portable device is used to determine the concentration of tracer in the production fluid.

26. The method of claim 2 further comprising:

ii) if any tracer is detected during the prescreening, then:

A) analyzing the production fluid for a concentration of the chemical tracer used in the prescreening and present in the production fluid; and B) calculating the amount of admixture recovered from the oil well using the concentration of the chemical tracer present in the production fluid as a basis for the calculation.

* * * * *